United States Patent [19]

Magnuson

[11] 4,357,857

[45] Nov. 9, 1982

[54] LOADING APPARATUS FOR RAPID FIRE WEAPON

[75] Inventor: Roland A. Magnuson, Seattle, Wash.

[73] Assignee: Paccar Inc., Bellevue, Wash.

[21] Appl. No.: 55,065

[22] Filed: Jul. 5, 1979

[51] Int. Cl.[3] ..... F41D 5/02

[52] U.S. Cl. ..... 89/156; 89/33 MC

[58] Field of Search ..... 89/155, 156, 157, 24

[56] References Cited

U.S. PATENT DOCUMENTS

| | | | |
|---|---|---|---|
| 282,553 | 8/1883 | McLean | 89/33 MC |
| 2,845,007 | 7/1958 | O'Brien | 89/155 |
| 2,876,680 | 3/1959 | Meyer et al. | 89/156 |
| 3,505,927 | 4/1970 | Driscoll | 89/156 |
| 3,535,980 | 10/1970 | Chiabrandy et al. | 89/157 |
| 3,598,016 | 8/1971 | Chiabrandy et al. | 89/157 |
| 3,667,147 | 6/1972 | Goldin et al. | 89/24 |
| 3,866,513 | 2/1975 | Hornfeck et al. | 89/4 B |
| 4,240,324 | 12/1980 | Smith et al. | 89/156 |

*Primary Examiner*—Stephen C. Bentley

*Attorney, Agent, or Firm*—Seed, Berry, Vernon & Baynham

[57] ABSTRACT

A loading apparatus for telescoped round ammunition for a rapid fire gun in which the loading occurs during the recoil and counter-recoil movements of the gun with the recoil and counter-recoil movements of the gun being employed to position a new round into the chamber, discharge the old round from the chamber and reposition the chamber in the breech. One or two magazines of new rounds can be selectively used. The chamber can be moved along tracks out of the breech and back into the breech or can be swung out of and into the breech.

9 Claims, 28 Drawing Figures

LOADING APPARATUS FOR RAPID FIRE WEAPON

BACKGROUND OF THE INVENTION

1. Field of the Invention

This invention pertains to rapid fire telescoped round weapons and, more particularly, to loading rapid fire telescoped round weapons.

2. Description of the Prior Art

Telescoped round ammunition has been recently developed and employs a loaded round which is cylindrical and of a constant diameter. The projectile can either be fully or partially encased in the cartridge case of the round.

Large caliber telescoped round weapons have heretofore been limited in firing rate due to the loading mechanisms available. In one known device the loading generally operated at the trunion axis to feed a new round into the chamber and discharge the spent casing. Generally the round in the trunion axis feed system had to be rotated 90 degrees to bring it into alignment with the barrel opening. This type of system requires a considerable amount of time for loading and discharging the spent casing.

SUMMARY OF THE INVENTION

It is an object of this invention to provide a rapid loading system which uses the recoil and counter-recoil movement of the weapon for loading a telescoped round and discharging the spend case from the chamber.

It is another object of this invention to provide a reliable telescoped round delivery apparatus to position the round within the chamber.

It is still another object of this invention to provide an improved delivery mechanism for bringing the telescoped rounds out of one or more magazines and positioning them relative to the chamber for insertion into the chamber.

Basically these objects are obtained by moving the chamber between a loading position outside of the breech into a firing position within the breech, delivering a new telescoped round from one or more magazines to the chamber when in said loading position, discharging the spent case from the chamber while in said loading position and then moving the chamber over the round and back into the breech using the recoil and counter-recoil movements of the weapon as the motive force for operating the loading apparatus.

In the preferred embodiment, a selector pawl carried by the moving gun barrel carries a round from a stationary magazine into position between a pair of opposed transversely spaced gripping jaws also moved with the gun barrel. The jaws position the round directly in front of a chamber which is either swung down into alignment with the jaws or is carried by tracks down into alignment with the jaws with the spent case being carried by the chamber. On counter-recoil, the chamber is moved forward with the gun barrel but the new round is held stationary by a one-way stop so that the chamber slides over the new round with the new round pushing the spent case rearwardly out of the chamber. The spent case is temporarily held suspended against the new round by a hook spring. Finally, as the chamber continues to move forwardly during counter-recoil, it is sumultaneously drawn up into the breech, off the stop and strips the spent case from the rear of the chamber to discharge the spent case. The weapon is then again ready for firing.

Advantageously, all of the motive force necessary for the loading operation is internally generated by the movement during recoil and counter-recoil of the weapon itself. Also, the round does not have to be rotated 90 degrees for alignment with the gun barrel, but is always in parallel alignment. The speed of loading is essentially dependent only upon the speed of recoil and counter-recoil so that the loading operation does not limit the speed of firing such that rapid burst firing can be easily accomplished.

FIG. **13*a*** is a schematic of a guide track for swinging the chamber.

Figure 14A:
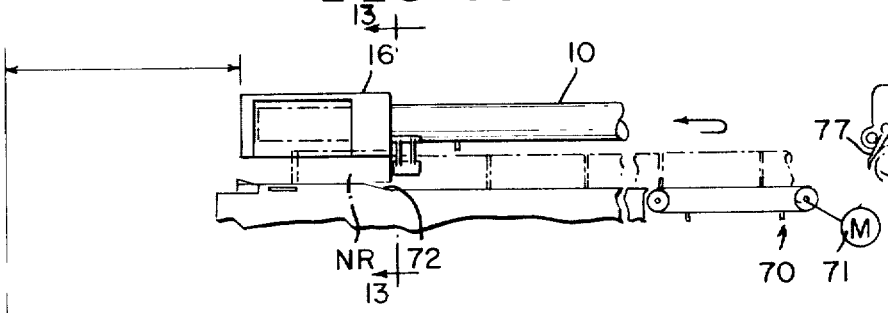
Figure 14B:
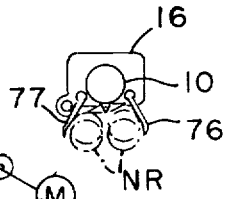

FIGS. 14A and 14B are fragmentary operational views of the second embodiment of the invention at beginning of recoil.

Figure 15A:
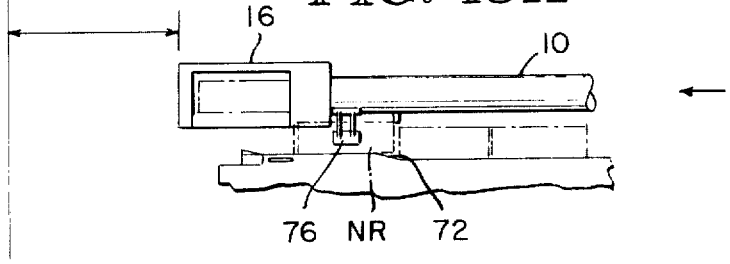
Figure 15B:
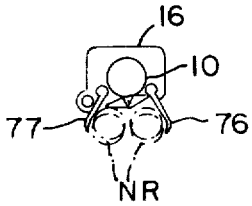

FIGS. 15A and 15B are operational views of the second embodiment during recoil as a new round is being removed from the magazine.

Figure 16A:
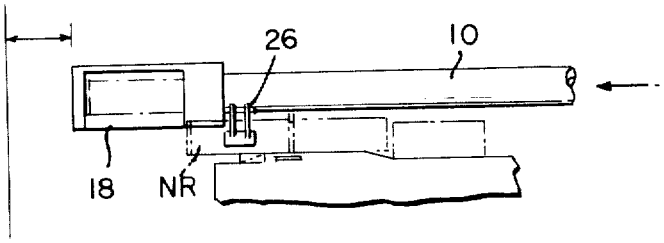
Figure 16B:
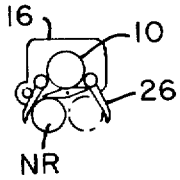

FIGS. 16A and 16B are operational views of the second embodiment during recoil with the round being carried rearwardly next to the chamber.

Figure 17A:
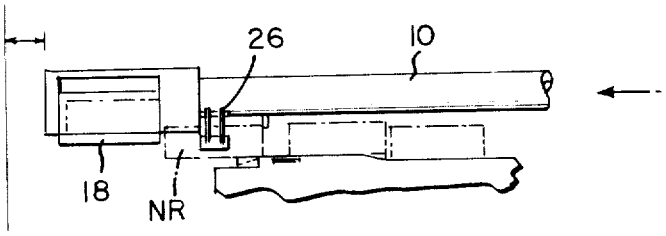
Figure 17B:
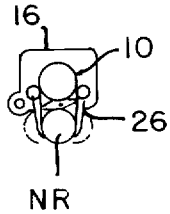

FIGS. 17A and 17B are operational views of the second embodiment approaching the end of recoil as the chamber is being swung down to coaxial alignment with the new round.

Figure 18A:
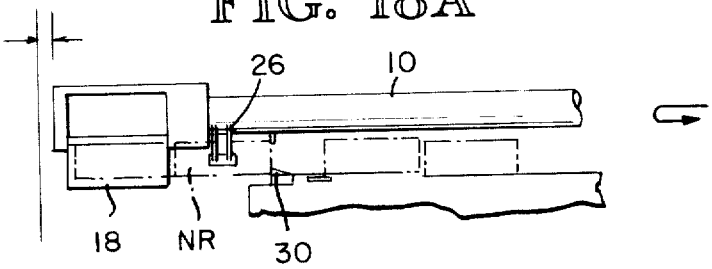
Figure 18B:
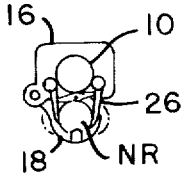

FIGS. 18A and 18B are operational views of the second embodiment at the beginning of counter-recoil with the new round now being held against forward movement and the chamber being moved coaxially of the new round to envelop the new round.

Figure 19A:
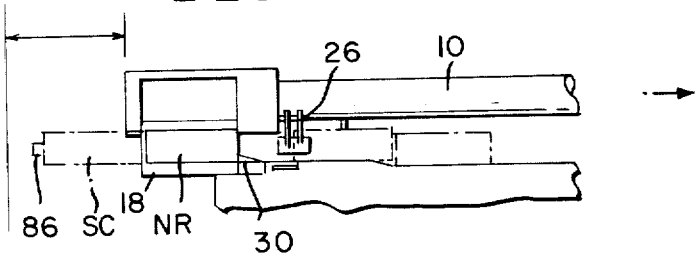
Figure 19B:
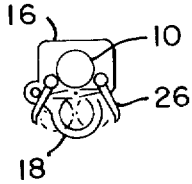

FIGS. 19A and 19B are operational views of the second embodiment with the new round enveloped by the chamber and pushing the spent casing to the rear.

Figure 20A:
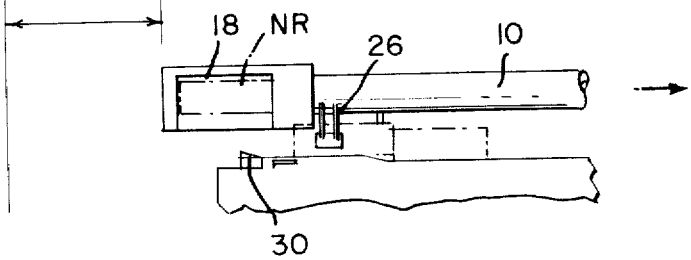
Figure 20B:
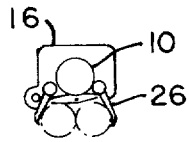

FIGS. 20A and 20B are operational views of the second embodiment at the beginning of counter-recoil.

DETAILED DESCRIPTION OF THE PREFERRED EMBODIMENTS

Figure 1:
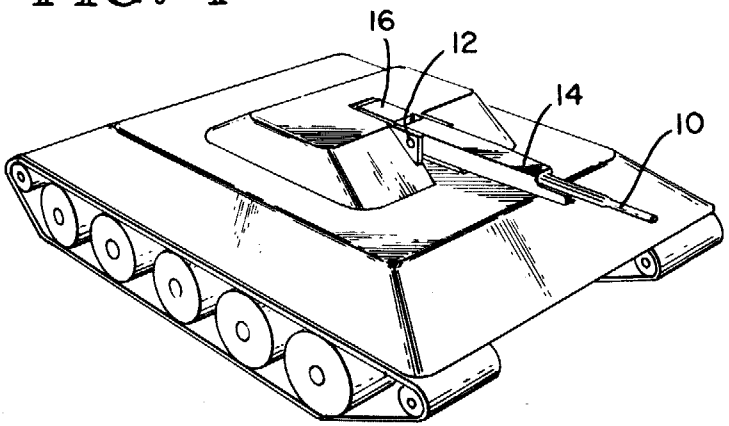
FIG. 1 is an isometric view of a weapon employing the improved loading apparatus of this invention.
Figure 2:
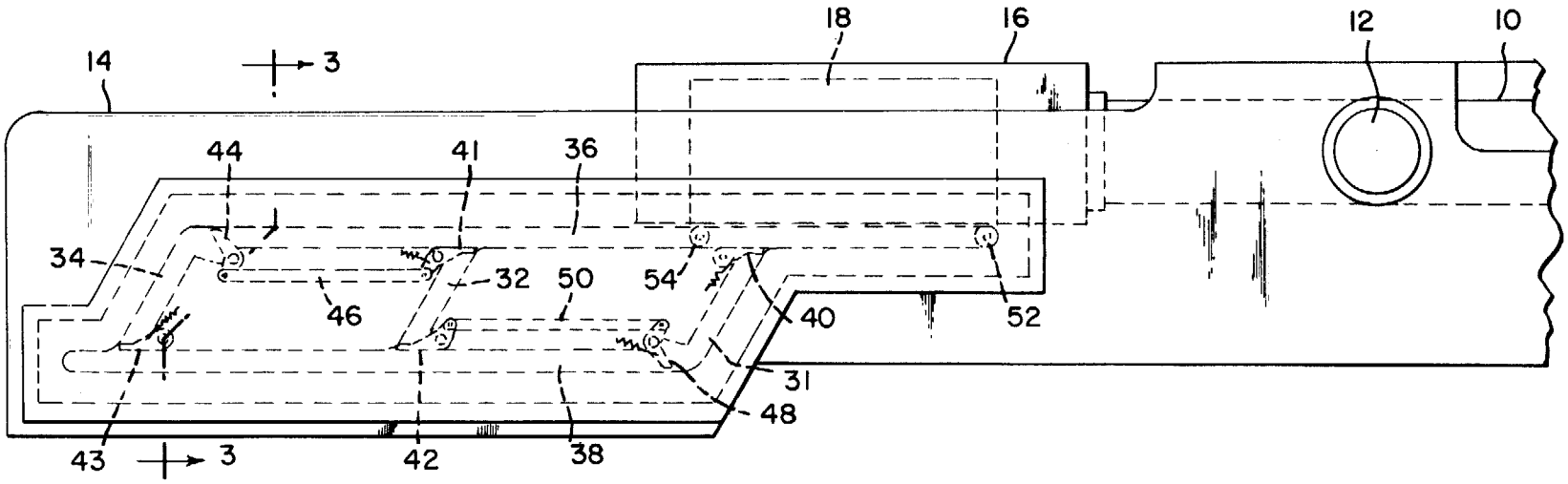
FIG. 2 is a side elevation of a portion of the weapon shown in FIG. 1.
Figure 3:
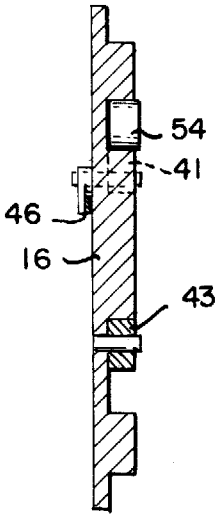
FIG. 3 is a fragmentary vertical section taken along the line 3—3 of FIG. 2.
Figure 4:
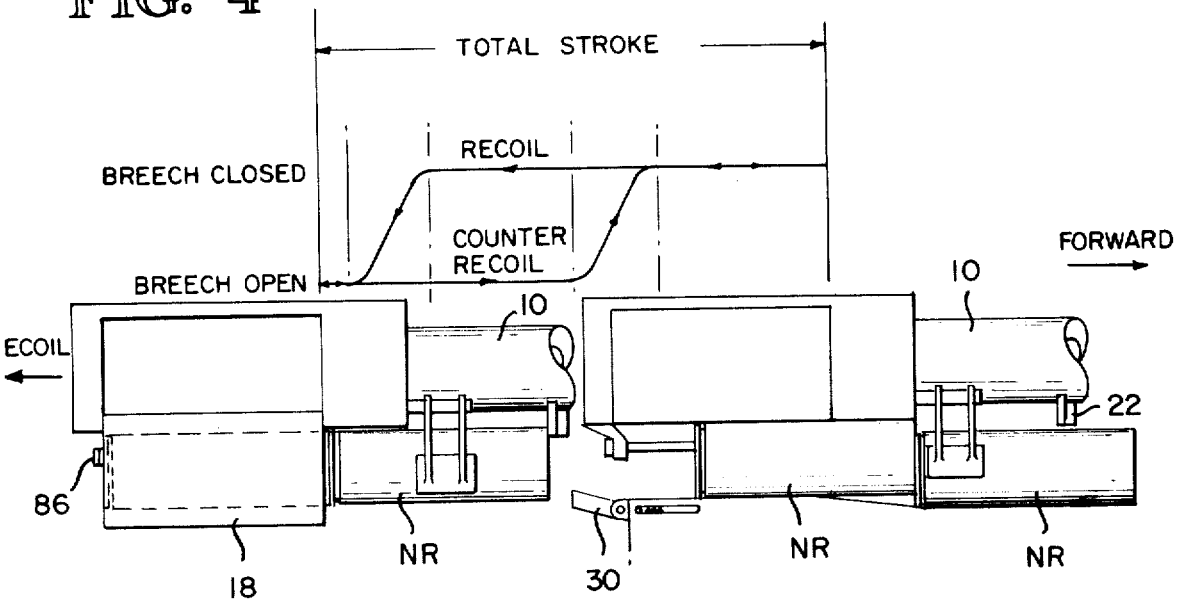
FIG. 4 is a schematic side elevation of a portion of the weapon shown in FIG. 1 illustrating a typical chamber movement during recoil and counter-recoil of the weapon.

As best shown in FIGS. 1 and 4, the weapon includes a barrel 10 mounted on trunions 12 and adapted to move forward and rearward in a stationary frame 14. The weapon is provided with a breech 16, a movable chamber 18, positioned within the breech in coaxial alignment with the barrel 10. As is understood, the type of weapon thus far described is for use with telescoped rounds NR of conventional design which are carried in one or preferably two magazines positioned below and slightly laterally of the barrel 10.

Figure 9:
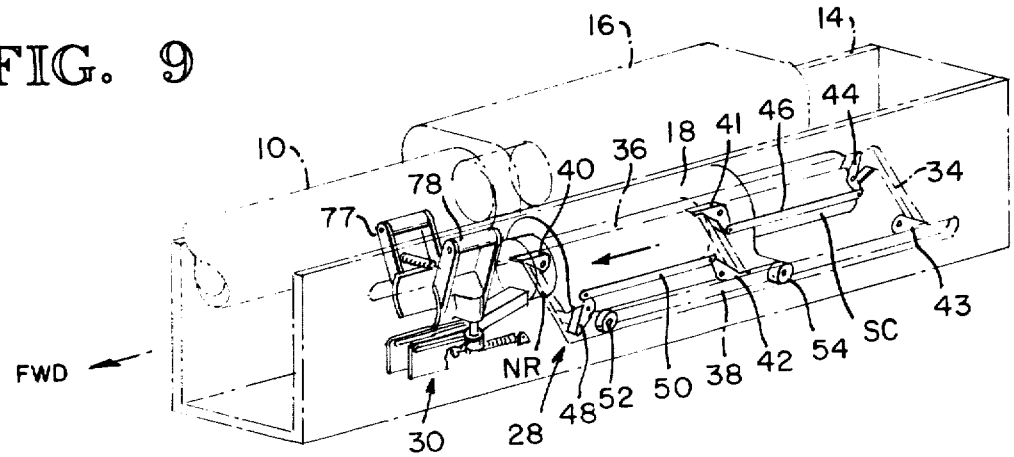
FIG. 9 is an isometric view with a new round being enveloped by the chamber and the spent case being pushed out the rear of the chamber during counter-recoil.
Figure 10:
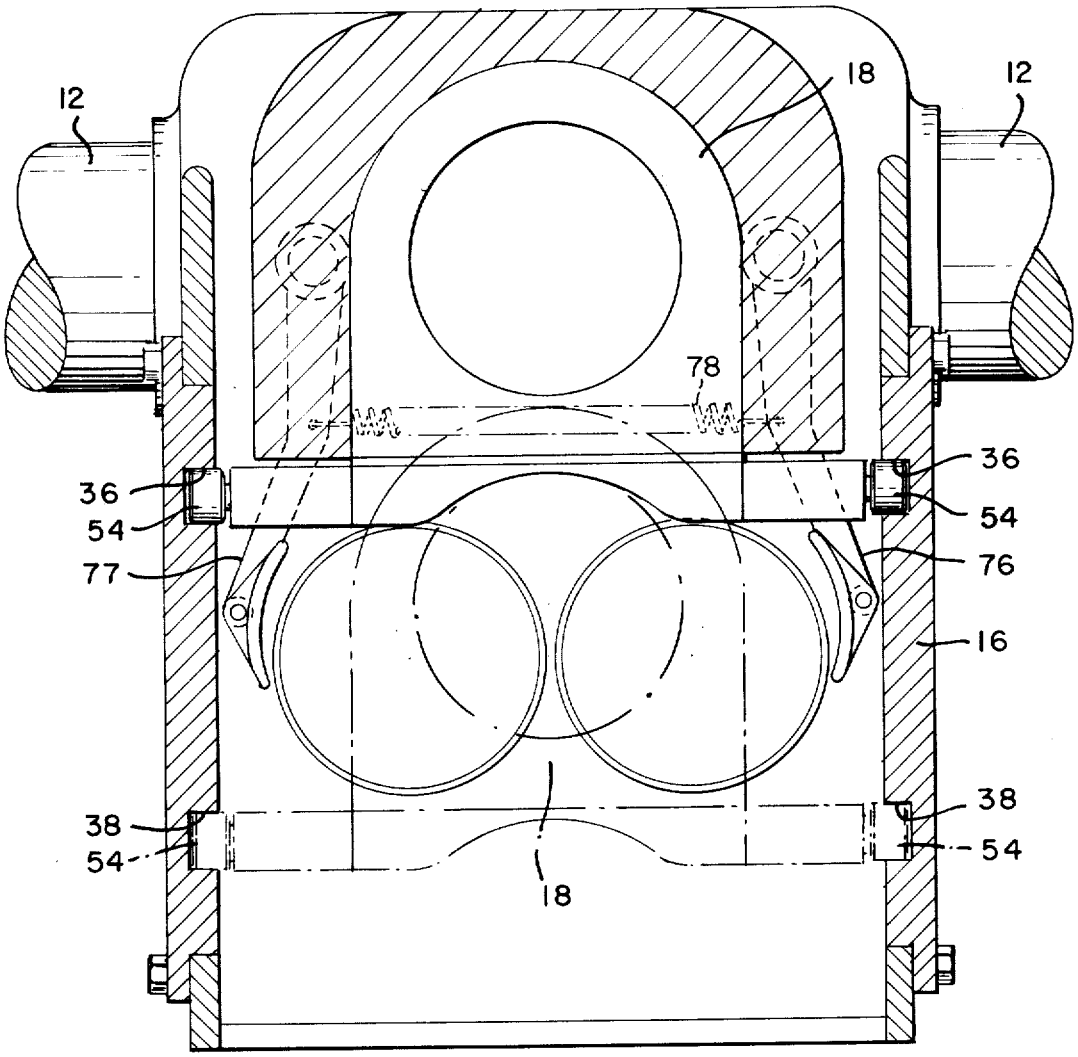
FIG. 10 is a fragmentary transverse section looking toward the forward end of the weapon.

In general, the rearwardmost round of one of the magazines is engaged by a selector pawl 22 which is manually operated by the gun operator and pushes the rearwardmost round NR rearwardly with the barrel during recoil. The new round is pushed between a set of opposed gripper jaws 26 which axially slidably hold the new round in parallel alignment with the barrel. A track mechanism 28 guides the chamber downwardly into alignment with the new round NR and during counter-recoil the chamber moves forwardly to slide over the new round with the new round being held against forward movement by a stop 30 (FIGS. 4 and 9). As the chamber is moved forward, the spent case SC (FIG. 9) is discharged from the chamber. Finally, the chamber moves back up into the breech firing position and the cycle repeats itself.

The track mechanism 28 includes a forward ramp 31, an intermediate ramp 32 and a rearward ramp 34. These ramps all interconnect with an upper horizontal run 36 and a lower horizontal run 38. At the upper extremities of the forward and intermediate ramps are a pair of gates 40 and 41. At the lower extremities of the intermediate and rearward ramps are a pair of gates 42 and 43. At the upper extremity of the rearward ramp is an upper gate opener 44 connected by a link 46 to the gate 41. The gate 41 is spring biased closed. At the lower extremity of the forward ramp 31 is a lower gate opener 48 which is joined by a link 50 to the gate 42. The gate 42 is spring biased closed.

The chamber is provided with forward and rearward sets of transversely spaced rollers 52 and 54. The rollers and track on each side of the frame 14 are identical so only one side will be described. The chamber when moving rearwardly relative to the track 28 rolls over the closed gates 41 and 40 until the rear rollers 54 engage the upper gate opener 44. This opens the gate 41 giving access to the intermediate ramp 32 such that continued rearward movement of the chamber simultaneously guides both the forward and rearward rollers down the intermediate and rearward ramp onto the lower horizontal run 38. Counter-recoil movement brings the chamber forwardly in the track 28 with the rollers 52 and 54 passing beneath the spring biased closed gates 42 and 43 until the forward rollers 52 engage the lower gate opener 48. Continued forward movement of the chamber 18 then simultaneously moves the rollers 52 and 54 up the ramps 30 and 32 until the chamber returns to the upper horizontal run 36 in coaxial alignment with the barrel 10. During this sequence of movements of the chamber the spent case is discharged and the new round is inserted in the chamber.

Figure 11:
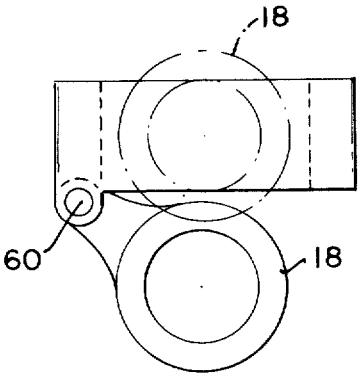
FIG. 11 is a fragmentary schematic transverse section of a second embodiment of the invention.
Figure 12:
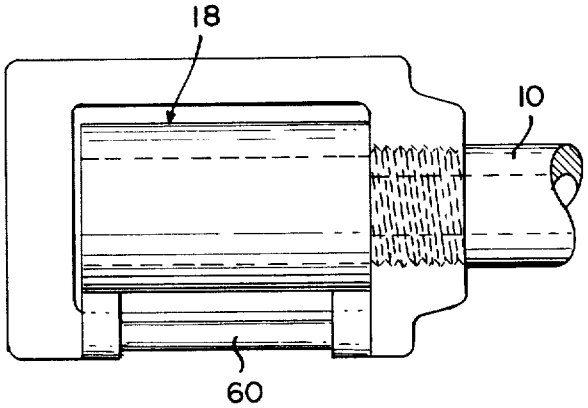
FIG. 12 is a fragmentary bottom plan of the breech area of the second embodiment.
Figure 13:
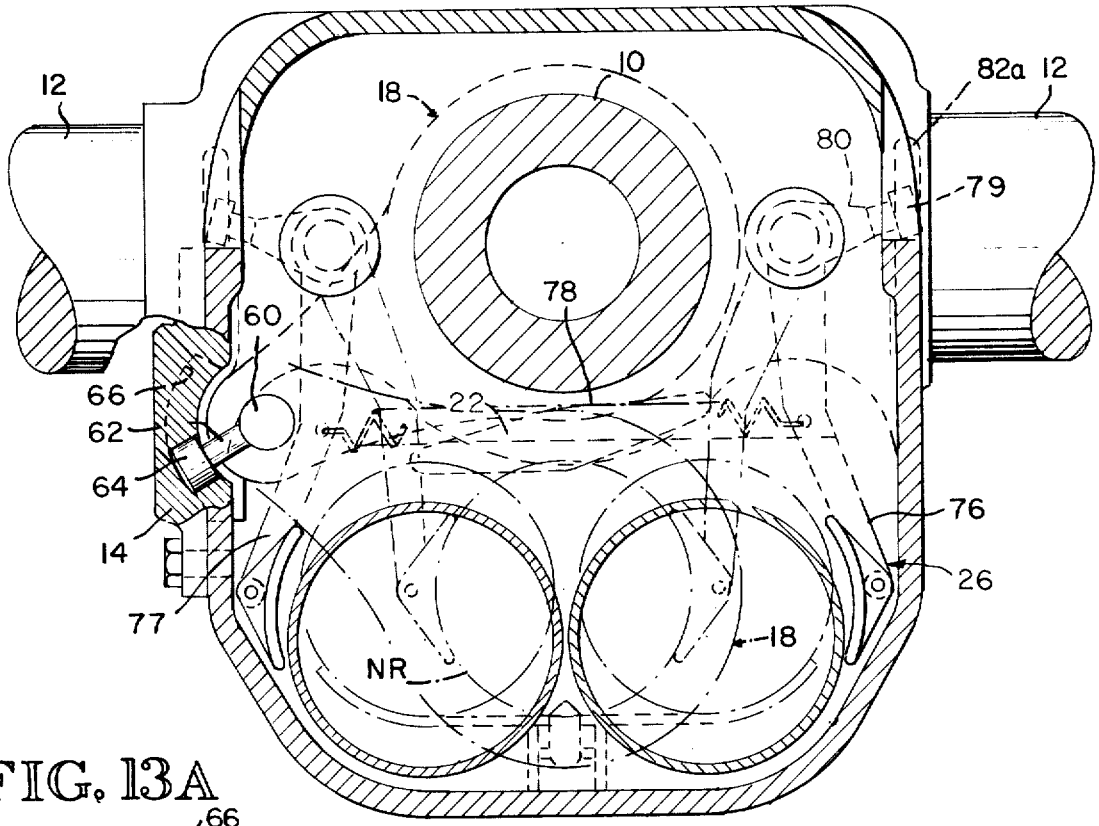
FIG. 13 is a transverse fragmentary section of the second embodiment looking generally along the lines 13—13 of FIG. 14A.
Figure 13A:
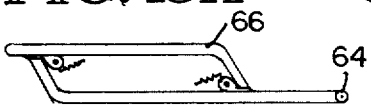

In the alternative embodiment illustrated in FIGS. 11-20B. The chamber is again lowered but by a swinging action rather than being guided by a track. As best shown in FIGS. 11-13, the chamber 18 is pivotally carried on a horizontal pivot 60 which is connected by a rigid link 62 to a cam roller 64. The cam roller 64 rides in a cam slot 66 in the stationary frame 14. Thus, during recoil, the chamber 18 is swung downwardly into alignment with the jaws 26 and receives a new round and discharges the spent case much as in the track embodiment.

In both embodiments a new round is fed by a suitable conventional pneumatic, hydraulic or pulley and cable magazine feed 70 (FIG. 14A) driven by a motor 71. The feed continuously presents a new round into the ready position shown by the new round NR. Advancing of the rounds in the magazine can also be accomplished by using the recoil force but the need to drive the system backwards for unloading the weapon and to activate it while loading makes an externally powered system more effective. The magazines can be loaded from the front or rear. As the rounds in the magazines are moved into position, they move up a ramp 72 placing the round beneath and laterally of the gun barrel 10.

Figure 5:
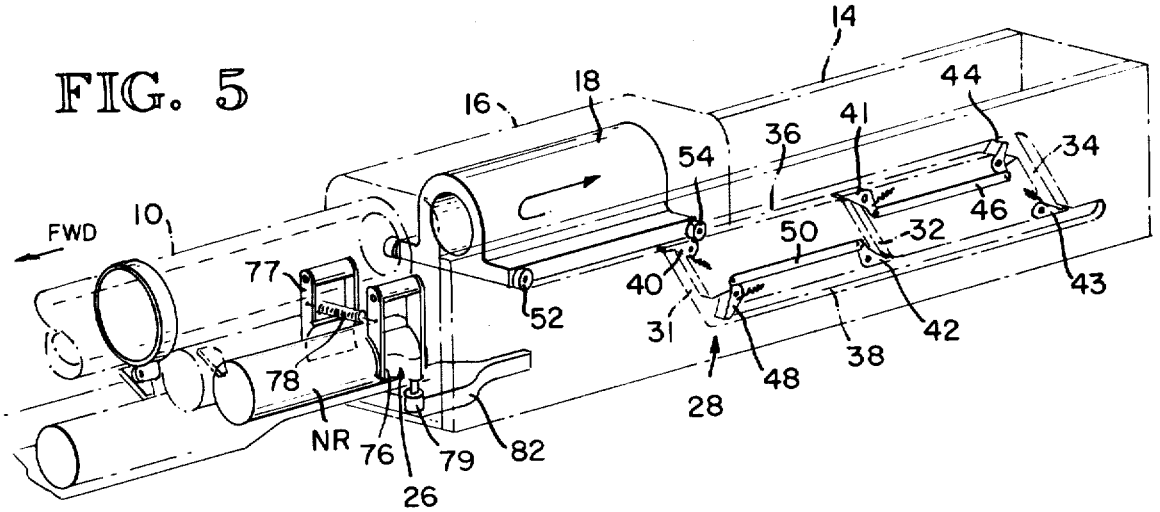
FIG. 5 is a fragmentary isometric with parts broken away for clarity illustrating the principles of operation of the rapid loading system of the weapon shown in FIG. 1 with the chamber within the breech and a new round positioned ready to be carried to the chamber as the gun begins to recoil.
Figure 6:
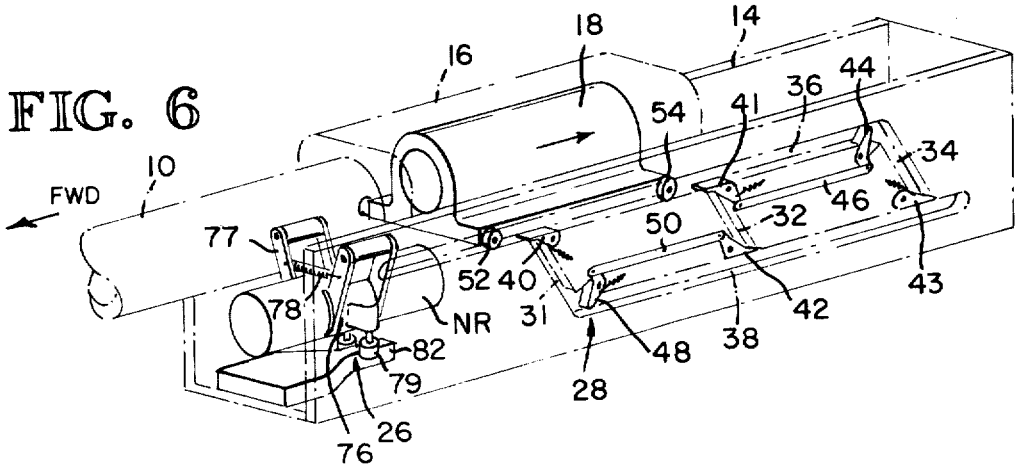
FIG. 6 is a schematic isometric view with the gun in recoil.
Figure 7:
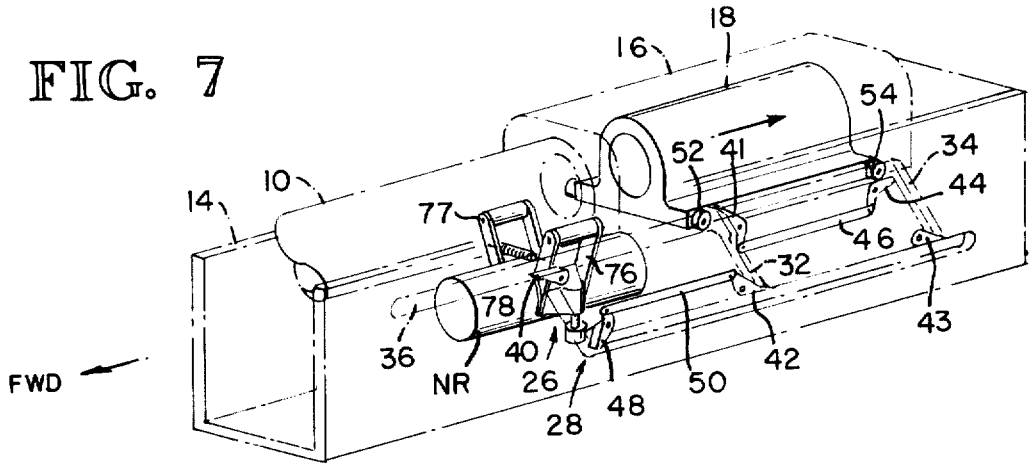
FIG. 7 is an isometric view with the gun in recoil and the chamber about to begin its downward movement out of the breech.
Figure 8:
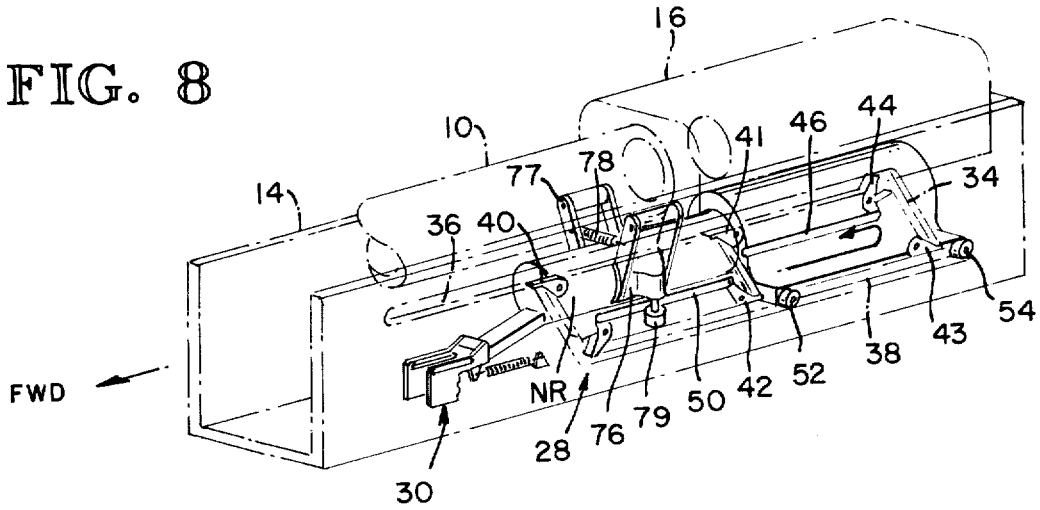
FIG. 8 is an isometric view with the chamber positioned out of the breech in coaxial alignment with a new round.

The jaws 26 are carried with the gun barrel and include a pair of jaw arms 76 and 77 joined by a spring 78. The arms are thus pivoted toward one another by the spring but are restrained by cam tracks 82*a* in the stationary gun frame 14. In each of the cam tracks is a cam roller 79 which is connected to a bell crank 80 that forms a part of the gripping arm 76. Both gripping arms function in an identical manner. As the weapon recoils, the gripping arms are moved rearwardly with the spring 78 and rollers 79 causing the arms to move simultaneously toward one another. Depending on which new round NR had been carried out of a magazine the gripper on that side will engage the new round and begin to move it toward the center line of the weapon. As the round becomes parallel to the axis of the gun barrel 10, both gripper arms engage and suspend the new round. In the track embodiment shown in FIG. 5 the cam track 78 is substituted by a cam plate 82 having opposite uniformly rearwardly converging cam surfaces 82. The rollers 79 follow these cam surfaces much as they are following the track 82*a* in the swing down embodiment of FIG. 13.

As the new round is carried rearwardly by the gripping jaws 26, the round passes over an upwardly biased stop 30. As the gun begins its counter-recoil, the new round is carried forward and engages the end of the stop 30. Further forward movement draws the chamber 18 over the new round which slides through the jaws 26. The old round or spent case SC is engaged by a hook 86 which is spring biased forwardly. The spent case is then suspended between the new round and the hook as shown in FIG. 19A. As the chamber begins to move further forwardly and up back into the breech, the new round slides upwardly off the stop 30 but at this time is fully inserted within the chamber. The chamber pulls into the breech stripping the spent case from between the new round and the hook 86 and the spent case falls clear. The gun is now ending its counter recoil and ready for firing.

While the preferred embodiments of the invention have been illustrated and described, it should be understood that variations will be apparent to one skilled in the art without departing from the principles herein. Accordingly, the invention is not to be limited to the specific embodiment illustrated in the drawing.

I claim:

1. Reloading apparatus in a rapid fire weapon of the type using rounds having projectiles and cylindrical rimless cartridge cases and having a frame, at least one magazine for supplying rounds, a gun barrel which moves axially in recoil and counter-recoil relative to the frame, a breech aligned behind the gun barrel, means for opening and closing the breech, and a chamber for positioning a new round in alignment with the gun barrel within the breech the improvement comprising:

means for moving said chamber between a loading position outside of said breech and into a firing position within said breech;

means for delivering a new round from said magazine to said chamber in said loading position; and means for discharging a spent round from said chamber;

said chamber being operatively connected to said moving barrel in recoil and counter-recoil, said chamber moving means, said spent round discharging means and said new round delivering means all being actuated directly by said weapon recoil and counter-recoil movement, said new round being held stationary relative to the frame while the barrel and chamber are moved relative to the frame in such counter-recoil over the new round to envelope the new round fully into the chamber, said chamber moving means including a track having multiple ramps interconnected by upper and lower horizontal runs, said track having a first path parallel to the direction of gun barrel movement in recoil for guiding the chamber rearwardly aligned with the barrel until near the end of recoil so that the chamber retains gases in the barrel until dissipated, said chamber having forward and rearward guide members seated in said track, said guide members following said track to lower the chamber along said ramps during recoil and following said track to raise the chamber along said ramps back into said breech during counter-recoil.

2. The apparatus of claim 1, said track including forward, intermediate and rearward parallel ramps, upper gates at each of the upper extremities of said intermediate and forward ramps at the junction of the ramps with the upper horizontal runs, lower gates at the lower extremities of the intermediate and forward ramps at the junction of the lower horizontal runs, and an upper gate opener located at the upper extremity of the rear ramp and a lower gate opener located at the lower extremity of the forward ramp, said upper and lower intermediate gates being spring biased closed and respectively interconnected by a link to said upper gate opener and said lower gate opener, respectively, whereby the rearward guide members on the chamber will during recoil engage said upper gate opener and open the intermediate gate for access to said intermediate ramp to guide the forward and rear guide members of the chamber simultaneously down said intermediate and rear ramps, said lower gate opener will be engaged during counter-recoil by said chamber forward guide members to open the intermediate lower gate for access to said intermediate ramp to guide the forward and rear guide members simultaneously up said forward and intermediate ramps.

3. Reloading apparatus in a rapid fire weapon of the type using rounds having cylindrical rimless cartridge cases and having a frame, at least one magazine for supplying rounds, a gun barrel which moves axially in recoil and counter-recoil relative to the frame, a breech aligned behind the gun barrel, means for opening and closing the breech; and a chamber for positioning a new round in alignment with the gun barrel within the breech, the improvement comprising:

means for moving said chamber between a loading position outside of said breech and into a firing position within said breech;

means for delivering a new round from said magazine to said chamber in said loading position; and means for discharging a spent round from said chamber;

said chamber moving means, said spent round discharging means and said new round delivering means all being actuated by said recoil and counter-recoil, said chamber being operatively attached with the moving barrel in recoil and counter-recoil, said chamber moving means including a pivot, and means for swinging the chamber downwardly about said pivot during recoil into a load position and upwardly during counter-recoil, said new round being held stationary relative to the frame while the barrel and chamber are moved relative to the frame in such counter-recoil over the new round to envelope the new round fully into the chamber.

4. Reloading apparatus in a rapid fire weapon of the type using rounds having cylindrical rimless cartridge cases and having a frame, at least one magazine for supplying rounds, a gun barrel, a breech aligned behind the gun barrel, means for opening and closing the breech; and a chamber for positioning a new round in alignment with the gun barrel within the breech, the improvement comprising:

means for moving said chamber between a loading position outside of said breech and into a firing position within said breech;

means for delivering a new round from said magazine to said chamber in said loading position; and means for discharging a spent round from said chamber;

said chamber moving means, said spent round discharging means and said new round delivering means all being actuatable by said weapon recoil and counter-recoil, said means for delivering a new round including a set of open, opposed gripping arms transversely spaced and forward of said breech, means for moving a new round to said gripping arms from said magazine, means for closing said gripping arms on a new round and positioning the gripping arms and new round centrally aligned below and forward of said breech, stop means engageable with said new round during counter-recoil for stopping forward movement of said round within said gripping arms, said chamber in said loading position being coaxially aligned with said new round when held by said stop means whereby continued forward movement of said chamber during counter-recoil slides said chamber over said new round to carry a new round into said breech.

5. The apparatus of claim 4, pawl means carried with said barrel and selectively engageable with a new round in said magazine and carrying the round rearwardly out of said magazine between said open gripping arms, and means for moving new rounds along said magazine.

6. Reloading apparatus in a rapid fire weapon of the type using rounds having cylindrical rimless cartridge cases and having a frame, at least one magazine for supplying rounds, a gun barrel, a breech aligned behind the gun barrel, means for opening and closing the breech; and a chamber for positioning a new round in alignment with the gun barrel within the breech, the improvement comprising:

means for moving said chamber between a loading position outside of said breech and into a firing position within said breech;

means for delivering a new round from said magazine to said chamber in said loading position; and means for discharging a spent round from said chamber;

said chamber moving means, said spent round discharging means and said new round delivering means all being actuatable by said weapon recoil and counter-recoil, said means for delivering a new round including a set of opposed gripping arms transversely spaced and forward of said breech, means for moving a new round to said gripping arms from said magazine, means for closing said gripping arms on a new round and positioning the gripping arms and new round centrally aligned below and forward of said breech, stop means engageable with said new round during counter-recoil for stopping forward movement of said round within said gripping arms, said chamber in said loading position being coaxially aligned with said new round when held by said stop means whereby continued forward movement of said chamber during counter-recoil slides said chamber over said new round to carry a new round into said breech, each said gripping arm including an elongated bell crank having a cam roller attached thereto, and stationary cam slots on said weapon frame for guiding the cam rollers as the gun recoils.

7. Reloading apparatus in a rapid fire weapon of the type using rounds having cylindrical rimless cartridge cases and having a frame, at least one magazine for supplying rounds, a gun barrel, a breech aligned behind the gun barrel, means for opening and closing the breech; and a chamber for positioning a new round in alignment with the gun barrel within the breech, the improvement comprising:

means for moving said chamber between a loading position outside of said breech and into a firing position within said breech;

means for delivering a new round from said magazine to said chamber in said loading position; and means for discharging a spent round from said chamber;

said chamber moving means, said spent round discharging means and said new round delivering means all being actuatable by said weapon recoil and counter-recoil, including a pair of transversely spaced magazines, pawl means being selectively engageable with a new round in each of said magazines and carrying the new round rearwardly out of each said magazine, and including ramp means at each magazine for raising a new round into a position for engagement by said pawl means.

8. Reloading apparatus in a rapid fire weapon of the type using rounds having cylindrical rimless cartridge cases and having a frame, at least one magazine for supplying rounds, a gun barrel, a breech aligned behind the gun barrel, means for opening and closing the breech; and a chamber for positioning a new round in alignment with the gun barrel within the breech, the improvement comprising:

means for moving said chamber between a loading position outside of said breech and into a firing position within said breech;

means for delivering a new round from said magazine to said chamber in said loading position; and means for discharging a spent round from said chamber;

said chamber moving means, said spent round discharging means and said new round delivering means all being actuatable by said weapon recoil and counter-recoil, said means for delivering a new round including means for carrying a new round rearwardly, means for stopping forward movement of the new round, said chamber moving means including means for moving the chamber into coaxial alignment with said new round while a spent case is in the chamber, and means for moving the chamber forwardly enveloping said new round into said chamber while discharging the spent case rearwardly, including spring hook means for resiliently holding the spent case as the chamber moves off from the case whereby the spent case is held by said hook means at the rear and the new round at the front, and means for moving the chamber and new round upwardly into said breech and stripping said spent case from between said hook means and said new round.

9. Reloading apparatus in a rapid fire weapon of the type using rounds having cylindrical rimless cartridge cases and having a frame, at least one magazine for supplying rounds, a gun barrel, a breech aligned behind the gun barrel, means for opening and closing the breech; and a chamber for positioning a new round in alignment with the gun barrel within the breech, the improvement comprising:

means for moving said chamber between a loading position outside of said breech and into a firing position within said breech;

means for delivering a new round from said magazine to said chamber in said loading position; and means for discharging a spent round from said chamber;

said chamber moving means, said spent round discharging means and said new round delivering means all being actuatable by said weapon recoil and counter-recoil, said means for delivering a new round including a set of opposed gripping arms transversely spaced and forward of said breech, means for moving a new round to said gripping arms from said magazine, means for closing said gripping arms on a new round and positioning the gripping arms and new round centrally aligned below and forward of said breech, stop means engageable with said new round during counter-recoil for stopping forward movement of said round within said gripping arms, said chamber in said loading position being coaxially aligned with said new round when held by said stop means whereby continued forward movement of said chamber during counter-recoil slides said chamber over said new round to carry a new round into said breech, pawl means carried with said barrel and selectively engageable with a new round in said magazine and carrying the round rearwardly out of said magazine between said open gripping arms, and means for moving new rounds along said magazine, said means for delivering new rounds including means for carrying a new round rearwardly, means for stopping forward movement of the new round, said chamber moving means including means for moving the chamber into coaxial alignment with said new round while a spent casing is in the chamber, and means for moving the chamber forwardly enveloping said new round into said chamber while discharging the spent case rearwardly, including spring hook means for resiliently holding the spent case as the chamber moves off from the case whereby the spent case is held solely by said hook means at the rear and the new round and chamber at the front, and means for moving the chamber and new round upwardly into said breech and stripping said spent case from between said hook means and said new round and chamber.

* * * * *